US005146273A

United States Patent [19]

Yamada

[11] Patent Number: 5,146,273

[45] Date of Patent: Sep. 8, 1992

[54] METHOD AND APPARATUS FOR PREVENTING ERRONEOUS IMAGE DENSITY DETECTION IN AN IMAGE FORMING APPARATUS

[75] Inventor: Takanobu Yamada, Toyokawa, Japan

[73] Assignee: Minolta Camera Kabushiki Kaisha, Osaka, Japan

[21] Appl. No.: 699,965

[22] Filed: May 14, 1991

[30] Foreign Application Priority Data

May 15, 1990 [JP] Japan ..... 2-125825

[51] Int. Cl.[5] ..... G03G 21/00

[52] U.S. Cl. ..... 355/208; 355/206; 355/246; 430/30

[58] Field of Search ..... 355/246, 215, 208, 207, 355/206, 214; 430/30

[56] References Cited

U.S. PATENT DOCUMENTS 4,539,279 9/1985 Murai et al. ..... 430/30
4,879,576 11/1989 Naito ..... 355/214
4,934,314 6/1990 Ideyama ..... 118/689
4,989,039 1/1991 Hayashi et al. ..... 355/208

FOREIGN PATENT DOCUMENTS 59-87465 5/1984 Japan ..... 355/208
59-53545 12/1984 Japan .

*Primary Examiner*—Joan H. Pendegrass
*Assistant Examiner*—Shuk Y. Lee
*Attorney, Agent, or Firm*—Willian Brink Olds Hofer Gilson & Lione

[57] ABSTRACT

A humidity sensor detects a relative humidity which is one of the conditions of surroundings. CPU judges a defective detection and stops an objective image forming operation when density is decreased despite an increase in humidity or when density is increased despite a decrease in humidity basing on an image density information related to AIDC pattern supplied from AIDC sensor and basing on a humidity information supplied from the humidity sensor.

14 Claims, 5 Drawing Sheets

METHOD AND APPARATUS FOR PREVENTING ERRONEOUS IMAGE DENSITY DETECTION IN AN IMAGE FORMING APPARATUS

BACKGROUND OF THE INVENTION

1. Technical Field of the Invention

The present invention relates to an image forming apparatus, and more particularly, to an image forming apparatus wherein an image density control method is adopted for varying developing conditions corresponding to an image density signal which is based on an image density detected so that the image density can be stabilized.

2. Description of Related Art

In an image forming apparatus which is arranged for forming a color image, for instance, color is reproduced by mixing toner of three primary colors of cyan, magenta and yellow. It is, therefore, necessary that image density (amount of toner adhesion) of the three primary colors to a photoconductor should be stabilized in order to perform satisfactory color reproduction.

In a conventional image forming apparatus, the following methods are known for stabilizing the amount of toner adhesion.

(1) Toner Density Control Method (ATDC)

In this method, toner density in a developer is detected by a variation in inductance of a coil, and corresponding to its detection signal, an amount of toner replenishment is controlled so that a toner mixing ratio to the developer can be set at a fixed value. In this method, however, only a toner mixing ratio is kept at a fixed value, and it cannot correspond with a variation in electric charge of a developer caused by a variation in surroundings. The amount of toner adhesion can not, therefore, be controlled at a fixed value to a variation in surroundings. Even under the same surroundings with the same amount of electric charge, an amount of toner adhesion is varied if other conditions (electric charge on the surface of photoconductor, sensitivity, amount of exposure and the like) are changed.

(2) Image Density Control Method (AIDC)

In this method, a standard pattern is formed on a photoconductor and its density is detected to control the amount of toner replenishment corresponding to the detection signal. Even if the amount of electric charge of a developer and other conditions are changed, the amount of toner is kept at a fixed value. However, since only toner mixing ratio deals with a variation in various conditions, the toner mixing ratio is liable to become abnormal to possibly result in fog and adhesion of carrier.

More specifically, when the humidity of surroundings is lower, toner is easily charged by friction with carrier, and therefore, toner is replenished in a manner to raise a toner mixing ratio by a control device since the amount of toner which adheres to an electrostatic latent image decreases in quantity. On the other hand, when a humidity is higher, toner is not easily charged, and the amount of toner which adheres to an electrostatic latent image increases in quantity. In this case, however, the toner mixing ratio can not be lowered since the toner already replenished can not be removed even if the toner replenishing operation is stopped, and developing operation in proper density can not be performed until the toner already replenished is completely consumed.

(3) Combined Method of ATDC and AIDC

This is a method which is arranged to compensate defective points of the above two methods, wherein the toner mixing ratio in a developer is always kept at a fixed value by the ATDC method, and the amount of toner adhesion (image density) is kept at a fixed value by the AIDC method by varying developing condition.

As a method of varying a developing condition, there is a method to vary rotational numbers of a developing sleeve which is provided for holding and transporting a developer for a developing operation. However, there arise problems in edge effects, reproduction of narrow line, adhesion of carrier, and the like. Moreover, the control system becomes complicated and increases manufacturing costs.

In order to deal with the problems, there is proposed a method of varying developing potential. More specifically, there is a method of controlling an electric potential of latent image to be developed on a photoconductor by varying an amount of electric charge to be charged on the photoconductor or by varying an amount of exposure to the photoconductor, and a method of varying a developing bias potential to be impressed on a developing device which is provided for developing a latent image. By employing the method of varying a developing bias, developing operation can be performed in the most stabilized state since the former method is hard to control in a stabilized state because of dark decay and quantity of light-surface potential characteristics.

In an image density detection process in the AIDC method, an amount of toner adhesion is detected by detecting an irregularly reflected light with a light receiving element upon irradiating infrared rays to a standard pattern since any colored toner can be reflected more than 90% if a light is of long wavelength. As shown in FIG. 6, an output of a sensor tends to be saturated when an amount of toner adhesion exceeds a certain quantity. This is because when more than one layer of toner is stuck, the surface area of the toner is not practically changed thereafter.

When a detection is made in the vicinity of one layer of toner adhesion in the AIDC method, a variation in sensor output to a variation in the amount of adhesion is so small that it is difficult to detect a variation in density. In order to solve this problem, a standard pattern is, therefore, formed in halftone pattern in the AIDC method, and developing bias is controlled so as to make an amount of adhesion at a fixed value assuming an amount of adhesion from the sensor output. However, since the halftone pattern is formed by making an amount of exposure (laser power) smaller, an area which largely varies in quantity of light amount-surface potential characteristic (LDC characteristic) is used as illustrated in FIG. 7, and the surface potential in the pattern portion is largely varied with a little variation in the quantity of light to result in lowering the accuracy in the pattern density, and eventually, the density detection is erroneously conducted to disorder an image.

SUMMARY OF THE INVENTION

A primary object of the present invention is to provide an image forming apparatus which can be advantageously utilized for forming a color image by mixing primary colors wherein an image can be formed in a stabilized density so that erroneous image density detection can be prevented in the AIDC method.

Another object of the present invention is to provide an image forming apparatus which is capable of surely preventing erroneous image density detection wherein an image density detection data is judged whether it is defective or not basing on a condition of surroundings from the relation between an image density and a condition of surroundings which affects the image density.

A further object of the present invention is to provide an image forming apparatus which is capable of preventing a defective image in an image forming operation by stopping the apparatus when an abnormal image density is detected.

A still another object of the present invention is to provide an image forming apparatus which is capable of forming an image basing on a preceding data and without being affected by a defective detection when a defective image density is detected.

These and other objects and features of the present invention will become more apparent from the following description taken in conjunction with the accompanying drawings which illustrate specific embodiments of the invention.

DESCRIPTION OF THE PREFERRED EMBODIMENT

Embodiment of the present invention will now be described hereinafter referring to the accompanying drawings.

Figure 1:
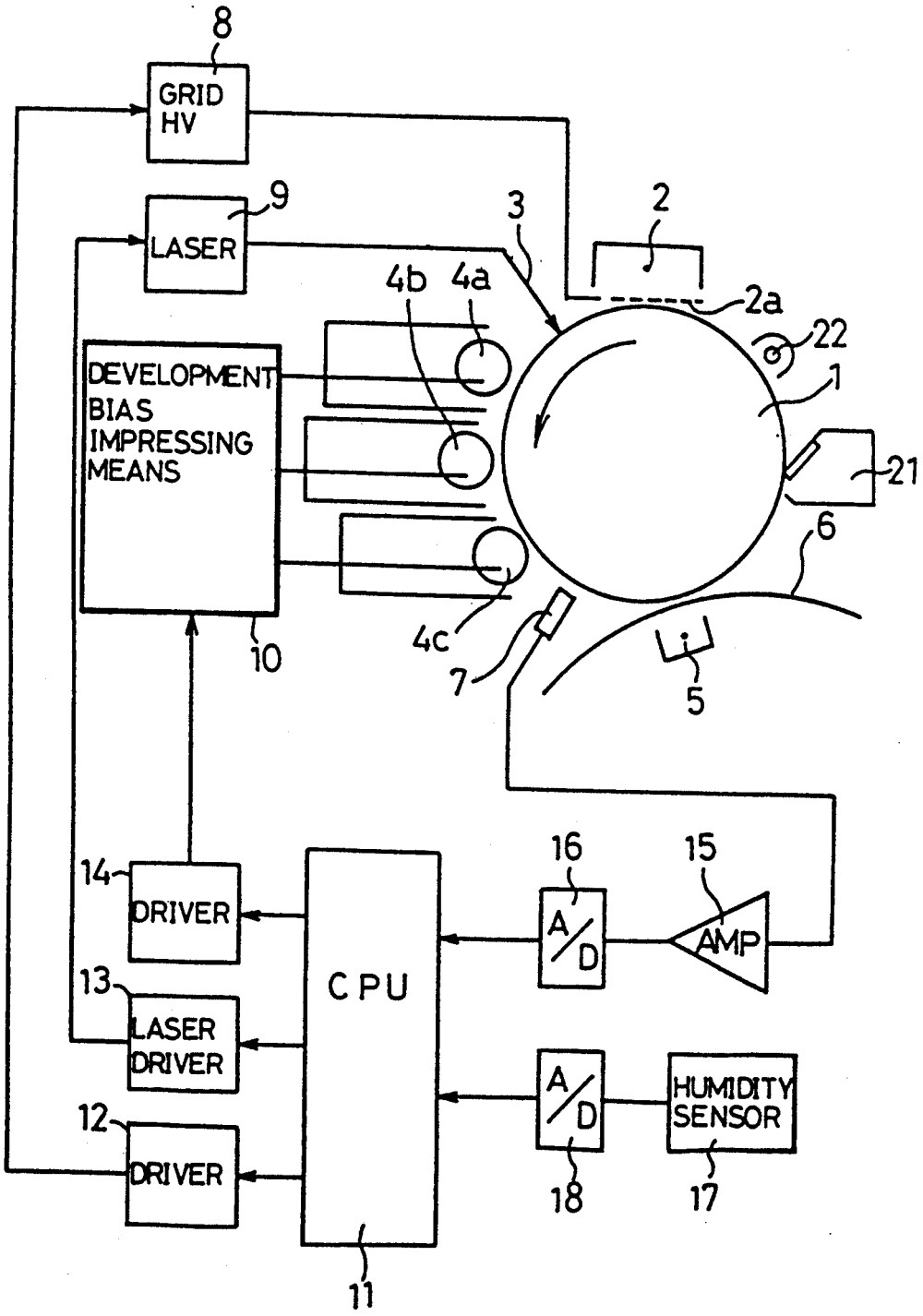
FIG. 1 is a schematic structural view showing the main part of an image forming apparatus to which the present invention is applied.

FIG. 1 shows an image forming apparatus which is capable of forming a color image to which the present invention is applied.

As illustrated in FIG. 1, around a photoconductive drum 1, there are sequentially disposed in the rotating direction of the photoconductive drum 1 a charger 2 comprised of scorotron charger for uniformly charging photoconductive layer of the photoconductive drum 1, exposure section 3 for forming an electrostatic latent image by an exposure based on an objective image, developing units 4a–4c for developing the electrostatic latent image with respective colored toner, a transfer charger 5 for transferring a developed toner image onto a transfer material 6, a cleaning device 21 for cleaning the surface of the photoconductive drum after transfer process, and an eraser 22 for removing electrical charge remaining on the photoconductive drum. Further, an image density detecting sensor 7 for detecting an amount of toner adhesion to the photoconductive drum 1, that is, an image density on the photoconductive drum 1, is provided between the developing device 4c and the charger 5 to detect an amount of toner adhesion to a standard pattern (hereinafter called as AIDC pattern) formed on the photoconductive drum 1.

Grid 2a of the charger 2 is controlled to a predetermined electric potential corresponding to a desired surface potential by a grid voltage setting means 8. At the exposure section 3, the surface of the photoconductive drum 1 is exposed by a laser light modulated corresponding to an image signal emitted from a laser 9.

The developing units 4a–4c perform developing operations by a two-component developer consisted of toner and carrier. The toner is charged in the same polarity as that of a latent image when it is frictionally contacted with carrier. The developing units 4a–4c are arranged to inversely develop latent image with the toner charged with the same polarity as that of the electrostatic latent image. In order to carry out the developing operation, developing sleeve of each developing unit 4a–4c is impressed with a predetermined developing bias by a developing bias impressing means 10.

The image exposure is performed on each color, and a color image is formed by subsequently transferring toner images developed by each developing unit 4a–4c onto the transfer material 6.

The grid voltage setting means 8, laser 9 and developing bias impressing means 10 are driven by each driver 12, 13, 14 controlled by CPU 11. The CPU 11 controls the image density of the AIDC pattern so as to be stabilized within a predetermined range by correcting a grid voltage $V_G$ which is set by the grid voltage setting means 8 and a developing bias $V_B$ which is impressed by the developing bias impressing means corresponding to the image density of the AIDC pattern. A detecting signal by the image density sensor 7 is, therefore, amplified by AMP 15 and converted into a digital signal by an A/D converter 16 to be inputted to the CPU 11.

The following variation factors on the amount of toner adhesion to be controlled are considered in the AIDC method; (1) condition of surroundings, especially the variation in electrical charge of developer affected by humidity, (2) deterioration of developer in long time use, (3) variation in sensitivity of photoconductor in long time use, (4) decline of surface potential by wear of photoconductive layer of photoconductor, and the like. Factors (2)–(4) are factors which gradually vary over a long period of time, while the factor (1) varies comparatively rapidly. The present invention is, therefore, arranged to prevent erroneous detection when the amount of toner adhesion is varied by the change of surroundings.

In the present embodiment, a change in the condition of surroundings is detected by a surrounding condition detecting means, and the present density is assumed from the preceding condition of surroundings, density detecting signal and a present surrounding condition detecting signal. When a measured value of density is found abnormal compared with the assumed density, it is judged that the detection is erroneous so that defective detection can be prevented, and the quality of image is properly protected from being disordered. The humidity change which largely affects the quality of image is specially considered.

More specifically, when humidity is low, toner is easily charged, and eventually, an amount of toner which adheres to a standard latent image is decreased. On the other hand, when humidity is higher, toner is not easily charged, and eventually, an amount of toner which adheres to the standard latent image is increased.

In other words, when humidity is increased, image density is also increased, while when humidity is decreased, image density is also decreased. Accordingly, basing on said relations, a variation in a detecting density related to the AIDC pattern is assumed from a variation in humidity, and when a detected value is defective compared to an assumed value, it is judged that the detection is defective. In order to make such a judgment, a humidity sensor 17 is provided for detecting relative humidity around the photoconductive drum 1, and its detecting signal is converted into a digital signal by an A/D converter 18 to be inputted to the CPU 11.

Figure 2:
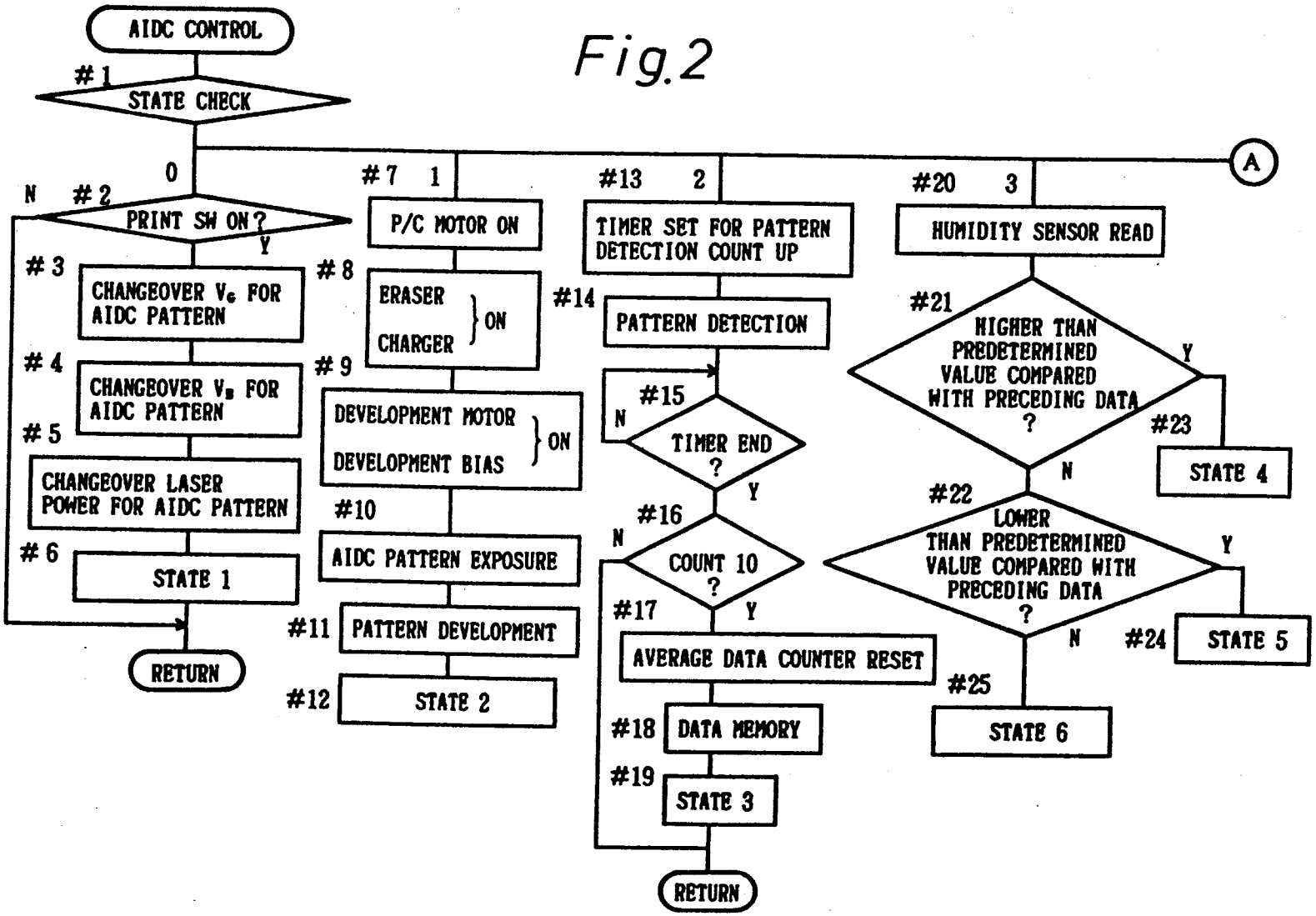
FIG. 2 is a flowchart of a part of AIDC control.
Figure 3:
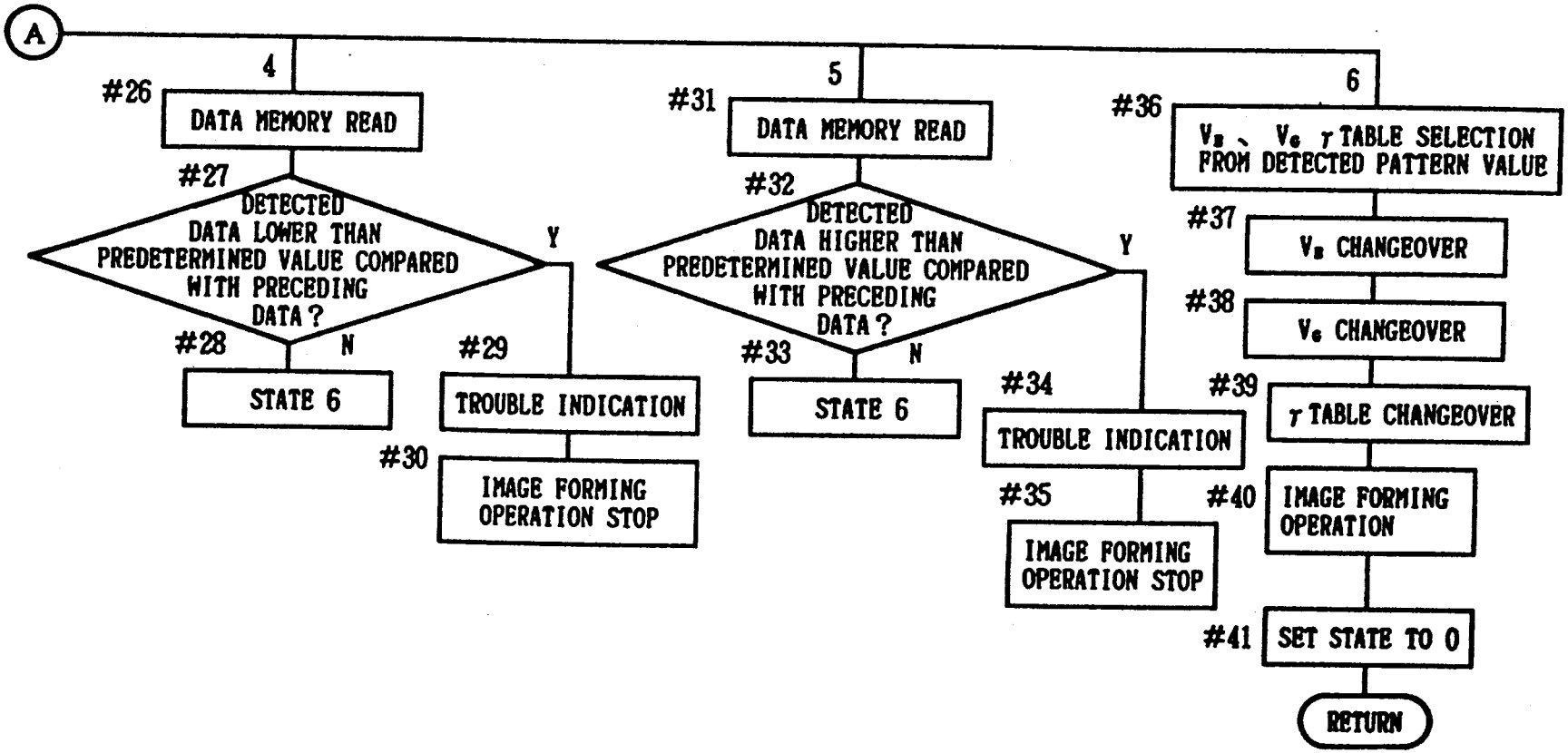
FIG. 3 is a flowchart of the remaining part of the AIDC control

An AIDC (image density) control by the CPU 11 will now be described with concrete numerical value referring to FIGS. 2 and 3. The image density control is generally performed on each color, however, in the following description, image density control on only one color will be described, and description on the other colors will be omitted.

In this control procedure, state check is conducted first. In state 0, when print switch is turned on (step #2), grid voltage $V_G$ is set to $-500V$ and developing bias $V_B$ to $-300V$ respectively for the AIDC pattern, and at the same time, laser power is set to 0.5 $mW/cm^2$ on the photoconductive drum 1 for halftone formation (steps #3-5), then the program is returned to state 1 (step #6).

In state 1, the photoconductive drum 1 is rotated (step 7), and the eraser and charger 2 are turned on. At the same time, the developing motor and developing bias impressing means 10 are turned on (steps 8, 9), then the AIDC pattern is exposed by the laser 9 to develop the pattern by the developing units 4a-4c (steps 10, 11), and the program proceeds to state 2 (step #12). At this time, the surface potential of the photoconductive drum 1 is $-480V$, the potential of the AIDC pattern $-220V$, the developing bias $-300V$ and the developing potential $-80V$ respectively.

In state 2, a pattern detecting timer to periodically decide sampling cycle is set, and at the same time, a counter for checking the number of sampling times is counted up (step #13). Then, image density of the AIDC pattern is detected by the image density sensor 7 (step #14). The timer is set at a value wherein ten times of samplings can be conducted when the AIDC pattern passes through the position opposite to the sensor 7 (steps #15). The program thereafter is returned to state 3 (step #19). When the detecting operation is repeated for ten times (step #16), the data for ten detecting operations are averaged (step #17), and the data is stored (step 18), and then the program is returned to state 3 (step #19).

Figure 4:
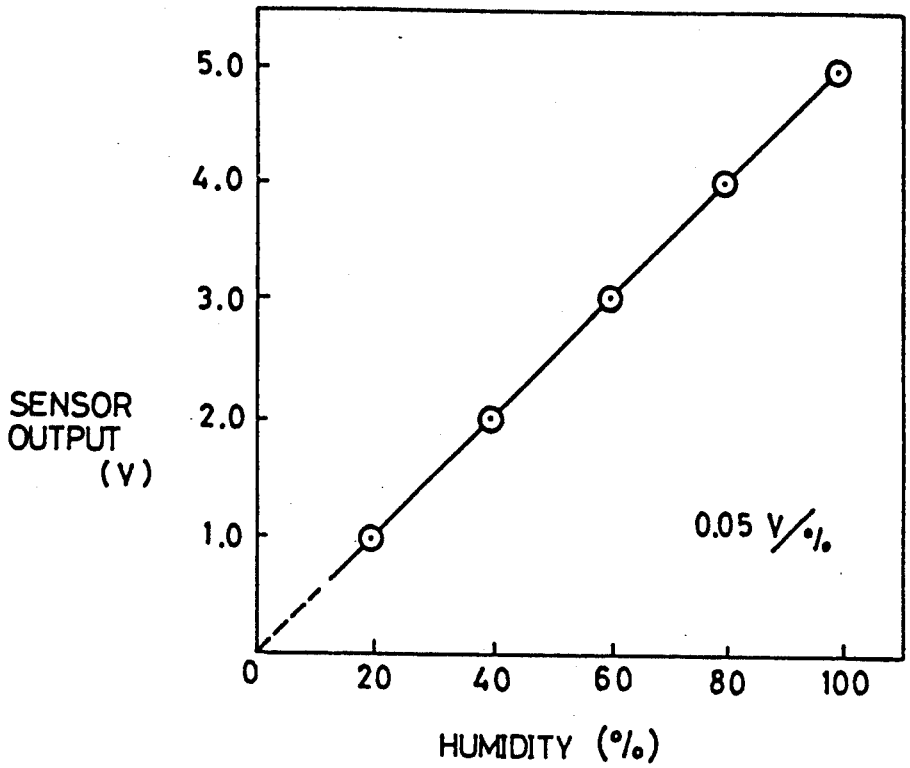
FIG. 4 is an output characteristic diagram of a humidity sensor.

In state 3, output of the humidity sensor 17 is read and stored (step #20). The output characteristic of the humidity sensor 17 is shown in FIG. 4. Then, humidity is compared with the humidity detected in the preceding AIDC control, and judgment is made whether or not it has varied more than 10% (more specifically, an output variation is 0.5V since the output characteristic of the humidity sensor 17 is 0.05V/%) (steps 21, 22). When the variation is more than 10% higher, state is set to 4 (step #23), while when the variation is less than 10% lower, state is set to 5 (step #24). When the variation is within the range of under 10%, state is set to 6 (step #25).

Figure 5:
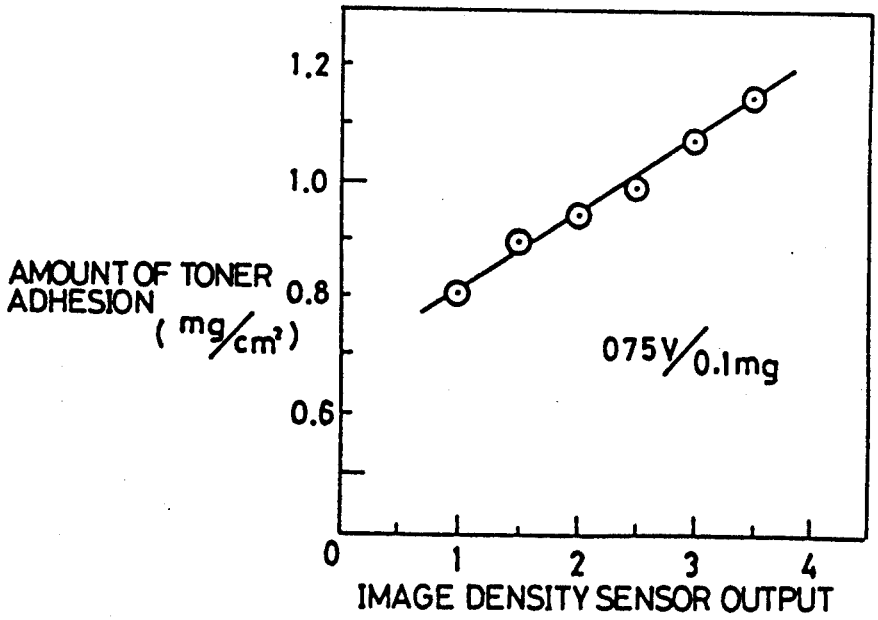
FIG. 5 is a characteristic diagram showing a relation between an image density sensor output and an amount of toner adhesion.
Figure 6:
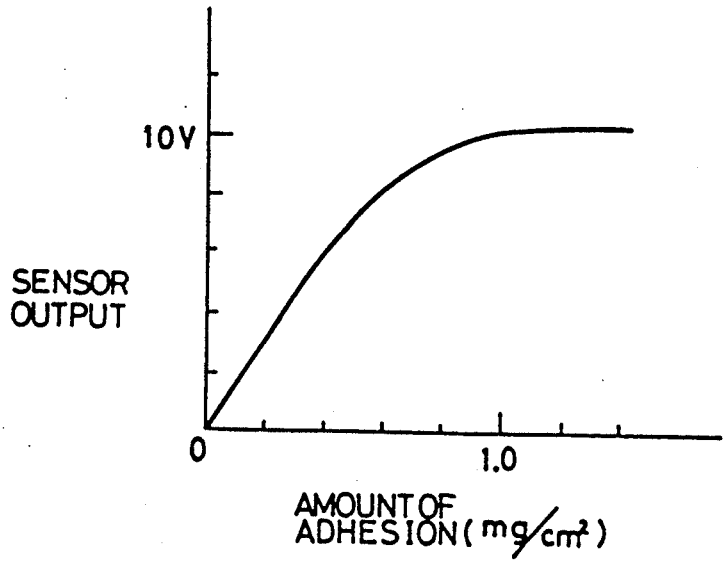
FIG. 6 is an output characteristic diagram of an image density sensor.
Figure 7:
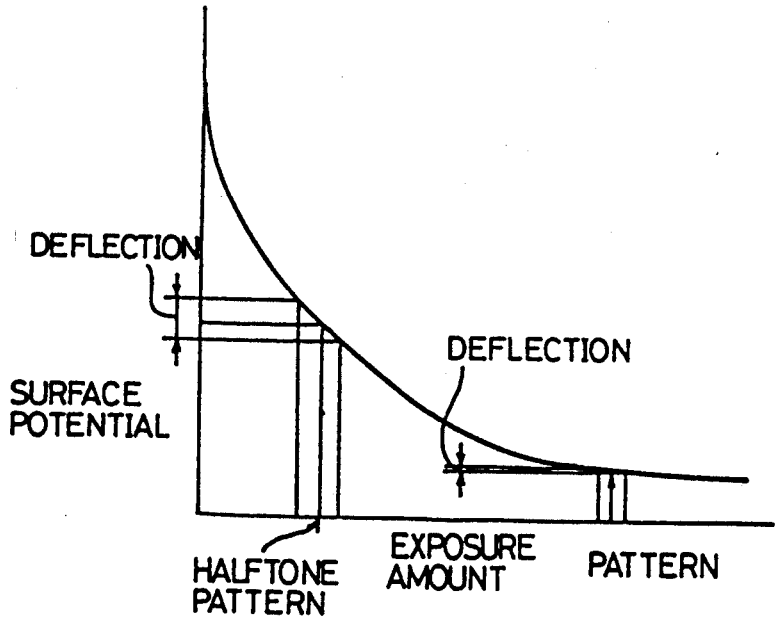
FIG. 7 is a characteristic diagram showing a relation between an exposure amount to a photoconductive drum and the surface potential of the photoconductive drum.

In states 4 and 5, the data stored in the preceding AIDC control and the present data detected by the image density sensor 7 are read (steps #26, 31), and judgment is made whether the variation in the data detected in the preceding and present detections are in the reverse direction or not to the variation of humidity (steps 27, 32). When it is not directed to the reverse direction, state 6 is set (steps #28, 33), while when it is directed to the reverse direction, trouble is indicated (steps #29, 34) to stop image forming operation of an objective image (steps #30, 35). More concretely, when an amount of toner adhesion to the AIDC pattern is lowered more than 0.1 $mg/cm^2$ (more specifically, output of the image density sensor 17 is more than 0.75V since the output characteristic of the image density sensor 7 is 0.75V/$cm^2$ as shown in FIG. 5) even the humidity is risen more than 10% higher, or reversely, when an output of the image density sensor 17 is risen more than 0.75V higher even the humidity is lowered more than 10%, it is judged that the detection is defective and the trouble is dealt with.

In state 6, basing on the pattern detection value of the image density sensor 7, developing bias $V_B$, grid voltage $V_G$, and table to be described later are selected from Table 1 (step #36), and they are converted into a value to be selected (steps #37-39). Then, an image forming operation of an objective image is conducted (step #40), and thereafter, state is set to 0 (step #41), and the program is returned. The output data of the image density sensor 7 is, as shown in Table 1, divided into density detection levels of 0-28, and corresponding to each one of the levels, setting values of the developing bias $V_B$ and grid voltage $V_g$ and table are stipulated.

TABLE 1

| Level | $V_B$ | $V_G$ | Table |
|---|---|---|---|
| 0 | −100 | −200 | $\gamma_0$ |
| 1 | −120 | −220 | $\gamma_1$ |
| 2 | −140 | −240 | $\gamma_2$ |
| . | . | . | . |
| . | . | . | . |
| . | . | . | . |
| 27 | −640 | −740 | $\gamma_{27}$ |
| 28 | −660 | −760 | $\gamma_{28}$ |

The $\gamma$table is a gamma rectifying table for rectifying an output of light emitting level of a laser relative to each image density level read in consideration of a gradation characteristic which is called as non-proportional $\gamma$characteristic between density level of an original image to be reproduced which is read, for instance, by an image reading apparatus in order to raise fidelity for reproduction of halftone image and density level of a toner image reproduced by an image forming apparatus, an example of which is shown in Table 2. In the Table 2, only the cases of $\gamma_0$ and $\gamma_{28}$ are shown, and other cases are omitted.

TABLE 2

| Input Level | 0 Output Level | 28 Output Level |
|---|---|---|
| 0 | 0 | 0 |
| 1 | 13 | 18 |
| 2 | 25 | 38 |
| 3 | 35 | 58 |
| 4 | 46 | 77 |
| 5 | 57 | 93 |
| 6 | 69 | 106 |
| 7 | 83 | 114 |
| 8 | 96 | 120 |
| 9 | 107 | 124 |
| 10 | 116 | 127 |
| 11 | 123 | 130 |
| 12 | 128 | 132 |
| . | . | . |
| . | . | . |

TABLE 2-continued

| Input Level | 0 Output Level | 28 Output Level |
|---|---|---|
| . | . | . |
| 246 | 820 | 647 |
| 247 | 836 | 663 |
| 248 | 852 | 681 |
| 249 | 869 | 700 |
| 250 | 887 | 721 |
| 251 | 905 | 747 |
| 252 | 924 | 780 |
| 253 | 949 | 838 |
| 254 | 973 | 897 |
| 255 | 1023 | 1023 |

A concrete example of the above image density control will now be described.

In the case when an output of the humidity sensor 17 is 3.0V (60% RH) and an output of the image density sensor 7 is 2.0V (0.95 mg/cm$^2$) in the preceding AIDC control, while an output of the present humidity sensor is 3.2V (64% RH), the program is moved to state 6 as it is since the variation in humidity is small, and a condition for image forming operation is set corresponding to an output of the image density sensor to form an objective image.

In the case when an output of the present humidity sensor is 2.5V (50% RH) and output of the image density sensor is 1.5V (0.90 mg/cm$^2$), the program is moved to state 5 since the humidity is lowered more than 10%. Since an output of the image density sensor is also lowered, the program is moved to state 6 to form an image as well.

When an output of the present humidity sensor is 2.5V (50% RH) and output of the image density sensor is 3.5V (1.5 mg/cm$^2$), trouble is indicated to stop image forming operation since there was a variation of more than 0.75V in the reverse direction.

In the present embodiment, the apparatus is stopped when the present detection is judged as defective, however, the preceding data may be used for an image forming operation in place of the present data which is judged as defective. It is also arranged in the present embodiment to compare a preceding data with a present data, however, it may also be arranged to compare an average of a plurality of preceding data (2–3) with the present data.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:
a photoconductor;
means for charging the photoconductor;
an exposure means for forming a latent image of an objective image on the photoconductor;
means for forming a standard latent image on the photoconductor;
means for developing a latent image on the photoconductor;
means for detecting a density of a developed standard visualized image by the standard latent image;
means for detecting a humidity;
means for storing the detected density and humidity;
means for making a comparison between a detected preceding humidity which is stored and a humidity which has just been detected;
means for preestimating a density of the present standard visualized image basing on the result of the comparison; and
means for judging as defective when the density of a detected standard visualized image differs from the density preestimated.

2. The image forming apparatus as defined in claim 1, wherein the preestimating means preestimates an increase of developing density of the standard latent image when humidity is increased.

3. The image forming apparatus as defined in claim 1, wherein the preestimating means preestimates a decrease of developing density of the standard latent image when humidity is decreased.

4. The image forming apparatus as defined in claim 1, further including means for stopping the apparatus when the present detection is judged as defective.

5. The image forming apparatus as defined in claim 1, further including means for controlling the image forming apparatus basing on the preceding data when the present detection is judged as defective.

6. An image forming apparatus, comprising:
a photoconductor;
means for charging the photoconductor;
an exposure means for forming a latent image of an objective image on the photoconductor;
the exposure means which is also arranged to form a standard latent image on the photoconductor prior to forming the objective image;
means for developing the latent image on the photoconductor;
means for detecting a density of a developed standard visualized image by the standard latent image;
means for setting conditions for developing the latent image of the objective image corresponding to the density of the developed standard visualized image;
means for detecting a humidity;
means for storing the detected density and humidity;
means for making a comparison between a detected preceding humidity which is stored and a humidity which has just been detected;
means for preestimating a density of the present standard visualized image basing on the result of the comparison;
means for judging as defective when the density of a detected standard visualized image differs from the density preestimated;
means for cleaning the surface of the photoconductor;
means for removing a residual charge on the photoconductor; and
means for transferring an objective image on the photoconductor onto a transfer material.

7. The image forming apparatus as defined in claim 6, further including means for stopping an objective image forming operation by the apparatus when the present detection is judged as defective.

8. The image forming apparatus as defined in claim 6, further including means for controlling an objective image forming operation basing on the preceding data when the present detection is judged as defective.

9. An image forming apparatus, comprising:
a photoconductor;
means for forming latent image of an objective image on the photoconductor;

means for forming a standard latent image on the photoconductor prior to forming the objective image;

means for developing a latent image;

a first detecting means for detecting a density of a developed standard visualized image by the standard latent image;

a first storing means for storing the detected density;

a second detecting means for detecting a humidity;

a second storing means for storing the detected humidity;

means for setting conditions for developing latent image of an objective image corresponding to the detected value obtained from the first detecting means;

a first means for judging a trend, increase or decrease, of variation of density;

a second means for judging a trend, increase or decrease, of variation of humidity; and a third means for judging as defective when the result of judgment by the first judging means differs from that of the second judging means.

10. The image forming apparatus as defined in claim 9, further including means for stopping the apparatus when the present detection is judged as defective.

11. The image forming apparatus as defined in claim 9, further including means for controlling the image forming apparatus basing on a preceding data when the present detection is judged as defective.

12. A method of forming an image, comprising the processes of:

forming latent image of an objective image on a photoconductor;

developing the latent image of the objective image;

forming a standard latent image on the photoconductor prior to forming the objective image;

developing the standard latent image;

judging a variation in density by detecting a density of a developed standard visualized image by the standard latent image and comparing it with a density previously detected;

setting conditions for developing latent image of an objective image corresponding to a detected density value;

judging a variation in humidity by detecting a humidity and comparing it with a humidity previously detected; and judging as defective when humidity is increased while density is decreased, and when humidity is decreased while density is increased.

13. The method as defined in claim 12, further including a process of stopping an objective image forming process when the present detection is judged as defective.

14. The method as defined in claim 12, further including a process for forming an objective image basing on a preceding data when the present detection is judged as defective.

* * * * *